US005909897A

United States Patent [19]

Lu

[11] Patent Number: 5,909,897

[45] Date of Patent: Jun. 8, 1999

[54] PHOTO ALBUM FOR STORING PICTURES AND APS FILM CARTRIDGES

[76] Inventor: Tsung-Tai Lu, No. 499, Chiu-Ju-Erh Rd., San-Min Dist.,Kaohsiung City, Taiwan

[21] Appl. No.: 08/914,864

[22] Filed: Aug. 19, 1997

[51] Int. Cl.[6] ..... B42D 1/08

[52] U.S. Cl. ..... 281/22; 402/73; 402/80 R; 281/36; 281/37

[58] Field of Search ..... 206/455, 361.1, 206/472, 216; D19/89; 40/722, 721; 281/31, 22, 36–38; 402/73–80 R, 4

[56] References Cited

U.S. PATENT DOCUMENTS 5,251,746 10/1993 Gresh et al. ..... 206/232

5,695,294 12/1997 Bedol et al. ..... 402/79

*Primary Examiner*—Frances Han

*Attorney, Agent, or Firm*—Sheridan Ross P.C.

[57] ABSTRACT

A photo album includes a binder shaft which has a receiving space therein for receiving APS film cartridges, and an opening communicated with the receiving space for passage of the APS film cartridges. Top and bottom cover sheets and picture holding sheets are hinged to the binder shaft. A cover can close the opening. The picture holding sheets have a plurality of picture pockets which are 3 inches in width and 10 inches in length for receiving three common specifications of APS picture types.

9 Claims, 6 Drawing Sheets

PHOTO ALBUM FOR STORING PICTURES AND APS FILM CARTRIDGES

BACKGROUND OF THE INVENTION

1. Field of the Invention

This invention relates to a photo album, more particularly to a photo album which is adapted for storing APS film cartridges and pictures developed from the APS film cartridges.

2. Description of the Related Art

The commonly available pictures are 3 inches in width and 5 inches in length, or 4 inches in width and 6 inches in length. Photo albums are designed to fit the specifications of such pictures. Referring to FIG. 1, a conventional photo album is shown to comprise a binder shaft 11, top and bottom cover sheets 12, 13, and a plurality of picture holding sheets 14 between the top and bottom cover sheets 12, 13. The cover sheets 12, 13 and the picture holding sheets 14 are hinged to the binder shaft 11. The picture holding sheets 14 are provided with a plurality of picture pockets 15 which are 3 inches (or 4 inches) in width and 5 inches (or 6 inches) in length for receiving pictures (not shown). In addition, for storing the processed films, another film album is required.

The presently developed APS (Advanced Photo System) technique permits an APS film to be stored and maintained in its cartridge according to its original state after development. The contents of the negatives in the film cartridge can be referred to as a set of compact-sized pictures developed from the film cartridge. In addition, with such a film cartridge, one may make different sizes of pictures, such as a standard size of 3×5 inches, an HDTV type of 3×6.25 inches, and a panoramic type of 3×10 inches. The conventional photo album is unsatisfactory for storing different sizes of APS pictures and APS film cartridges.

SUMMARY OF THE INVENTION

The main object of the present invention is to provide a photo album which can store both APS film cartridges and different specifications of pictures developed from the APS film.

According to this invention, a photo album includes a binder shaft which has a receiving space therein for receiving APS film cartridges, and an opening communicated with the receiving space for passage of the APS film cartridges. Top and bottom cover sheets and picture holding sheets are hinged to the binder shaft. A cover can close the opening. The picture holding sheets have a plurality of picture pockets which are 3 inches in width and 10 inches in length for receiving three common specifications of APS picture types.

BRIEF DESCRIPTION OF THE DRAWINGS

Other features and advantages of the present invention will become apparent in the following detailed description of preferred embodiments of the invention, with reference to the accompanying drawings, in which.

DETAILED DESCRIPTION OF THE PREFERRED EMBODIMENTS

Figure 1:
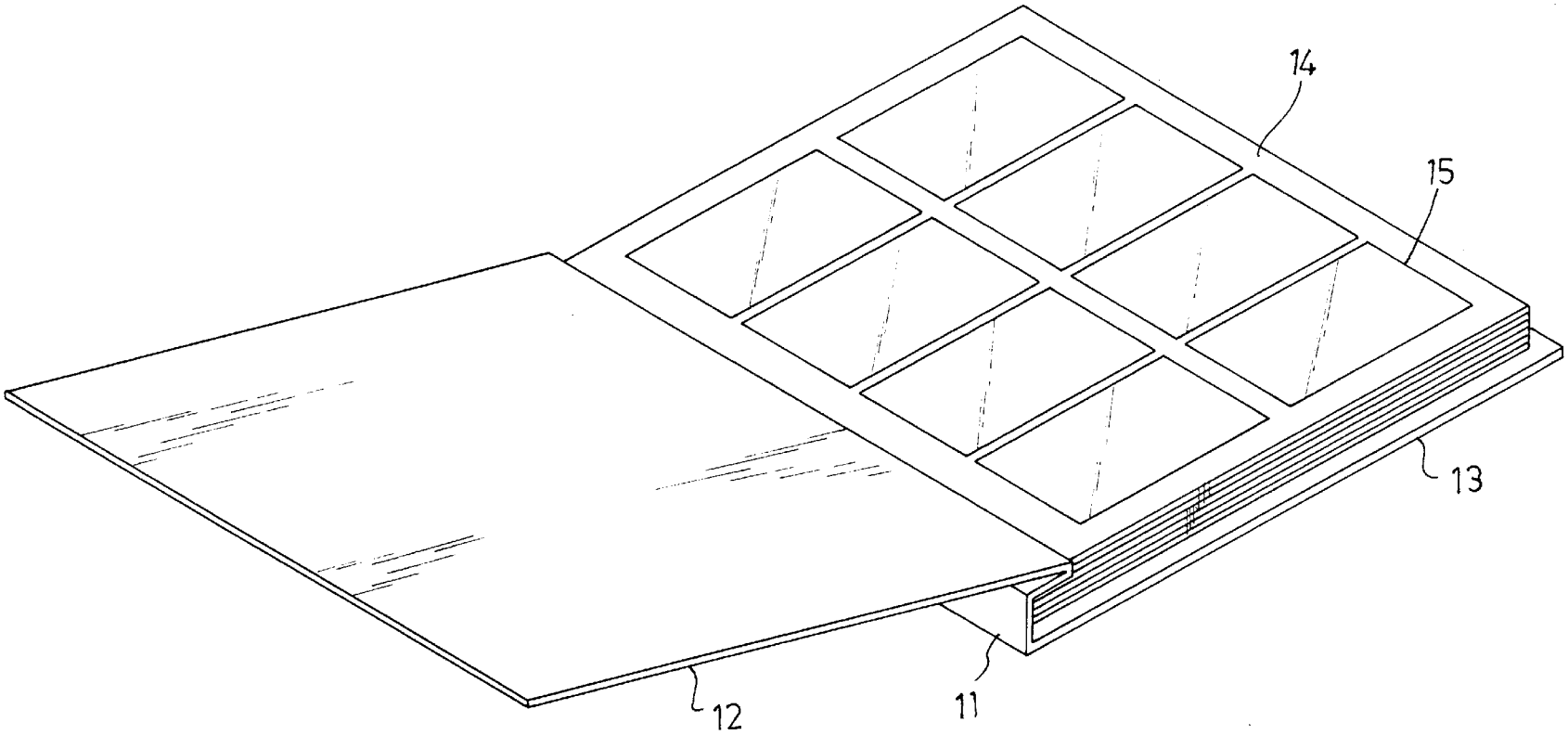
FIG. 1 PRIOR ART
FIG. 1 is a perspective view of a conventional photo album.
Figure 2:
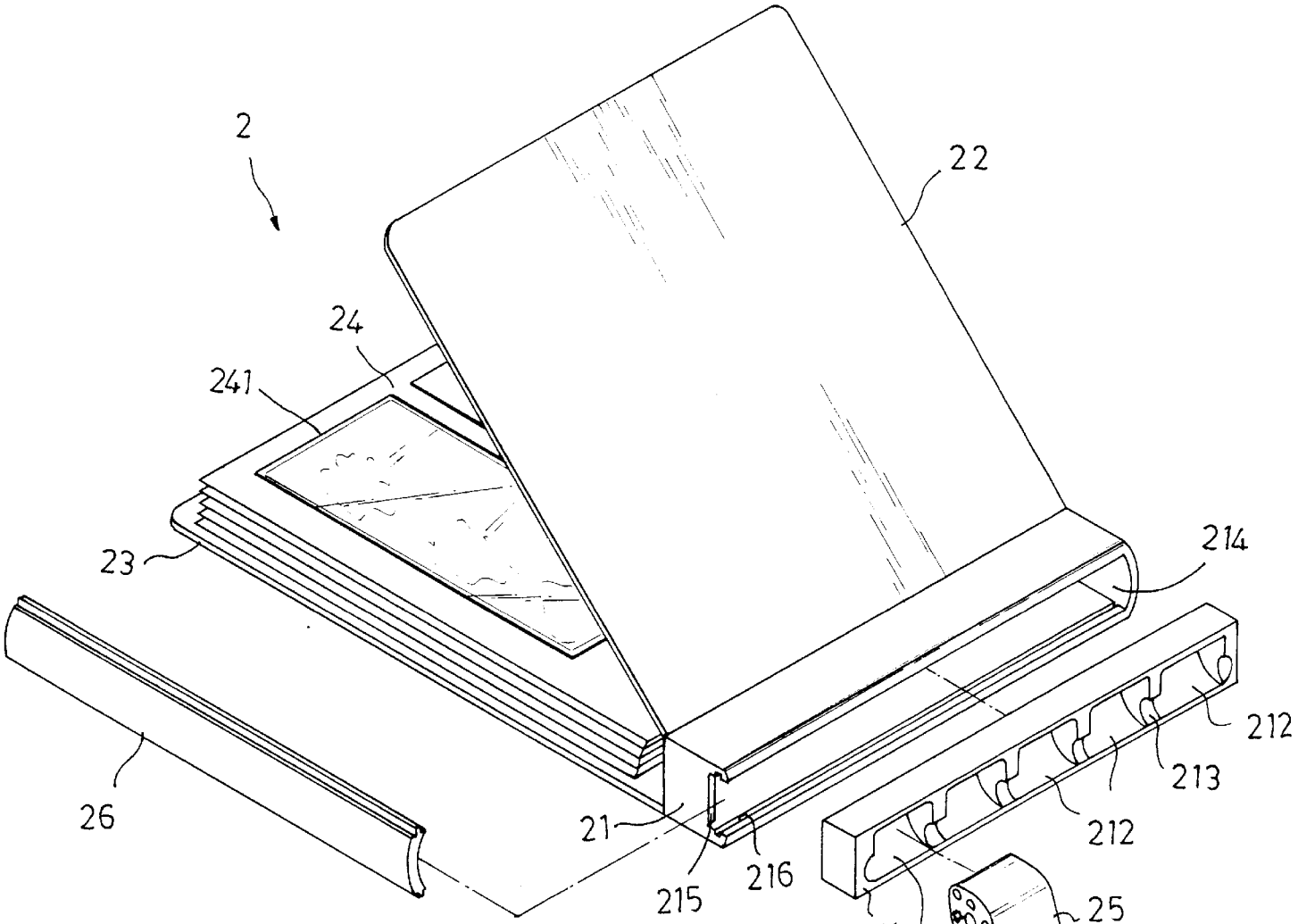
FIG. 2 is an exploded view of a first preferred embodiment of a photo album according to the present invention.

Referring to FIG. 2, the first preferred embodiment of a photo album 2 according to the present invention is shown to comprise an elongated binder shaft 21, top and bottom cover sheets 22, 23, and a plurality of picture holding sheets 24 which are sandwiched between the top and bottom cover sheets 22, 23. The top and bottom cover sheets 22, 23 and the picture holding sheets 24 have connecting edge portions which are hinged to the binder shaft 21. Each picture holding sheet 24 includes a plurality of picture pockets 241 which are 3 inches in width and 10 inches in length.

The binder shaft 21 is hollow and has a separate molded member 211 which is formed with a plurality of partitions to confine a plurality of compartments 212 for receiving APS film cartridges 25. The partitions are formed with cavities 213 to facilitate handling of the APS film cartridge 25 for loading or unloading. In addition, the binder shaft 21 has a longitudinal inner side which faces the picture holding sheets 24 and an outer side which is opposite to the inner side and which is formed longitudinally with an opening 214 that is closed by an elongated plate cover 26. A side recess 215 is formed in a transverse end of the binder shaft 21 and is communicated with the opening 214 to facilitate passage of the cover 26. Two rails 216 are formed in the binder shaft 21 adjacent to the opening 214 for slidable and detachable mounting of the cover 26.

Figure 3:
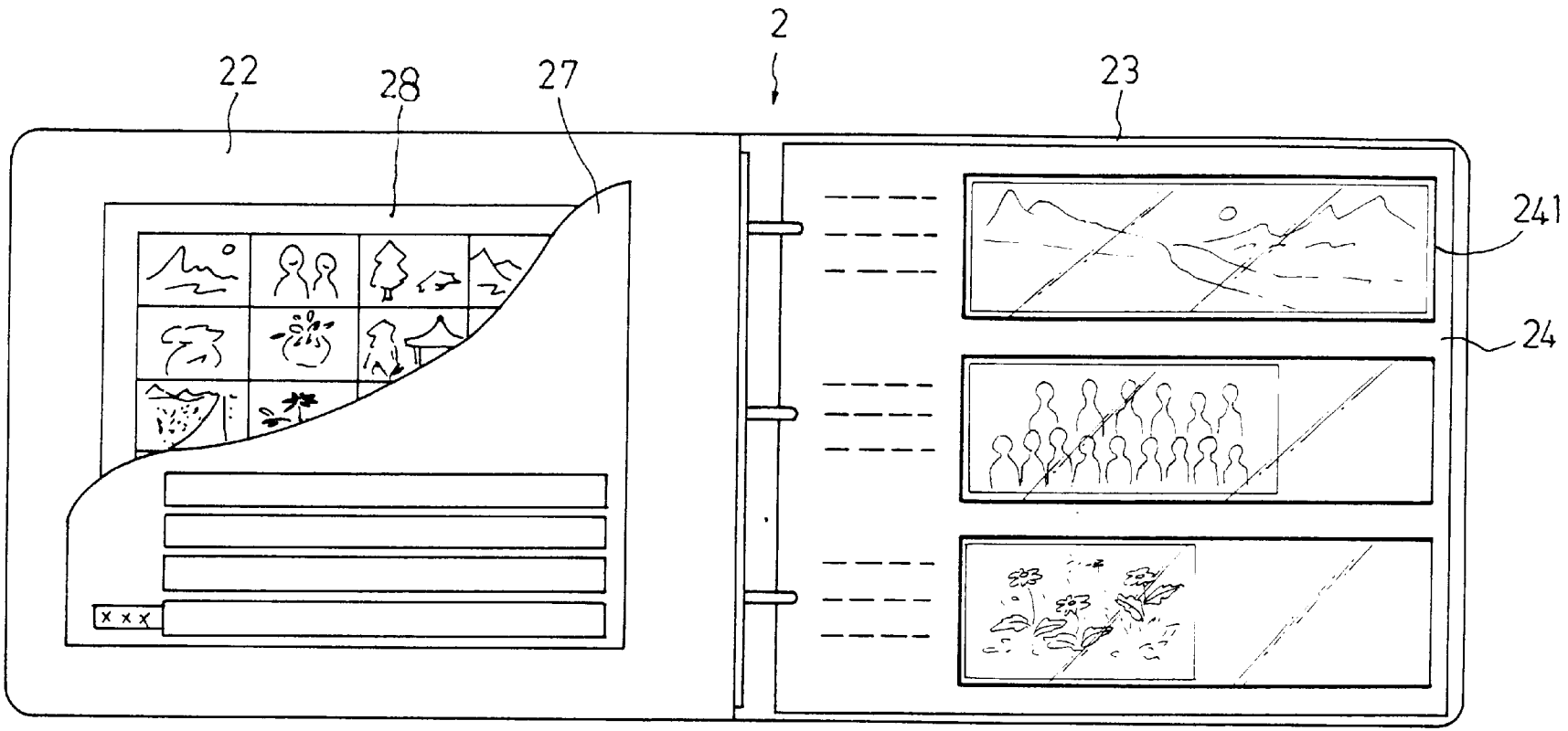
FIG. 3 is a schematic view of the photo album in an open state.

As mentioned above, because the picture pockets 241 are 3 inches in width and 10 inches in length, they can receive three common specifications of APS picture types, such as the classic type (3×5 inches), the HDTV type (3×6.25 inches), and the panoramic type (3×10 inches). In the same photo album 2, the corresponding APS film cartridges 25 can be received in the compartments 212, respectively. As such, the photo album 2 is convenient to store the different sizes of the APS pictures and the corresponding APS film cartridges 25. In addition, referring to FIG. 3, a pocket 27 is provided on an inside face of the top cover sheet 22 for receiving a catalog 28 for the pictures contained in the film cartridges 25.

Figure 4:
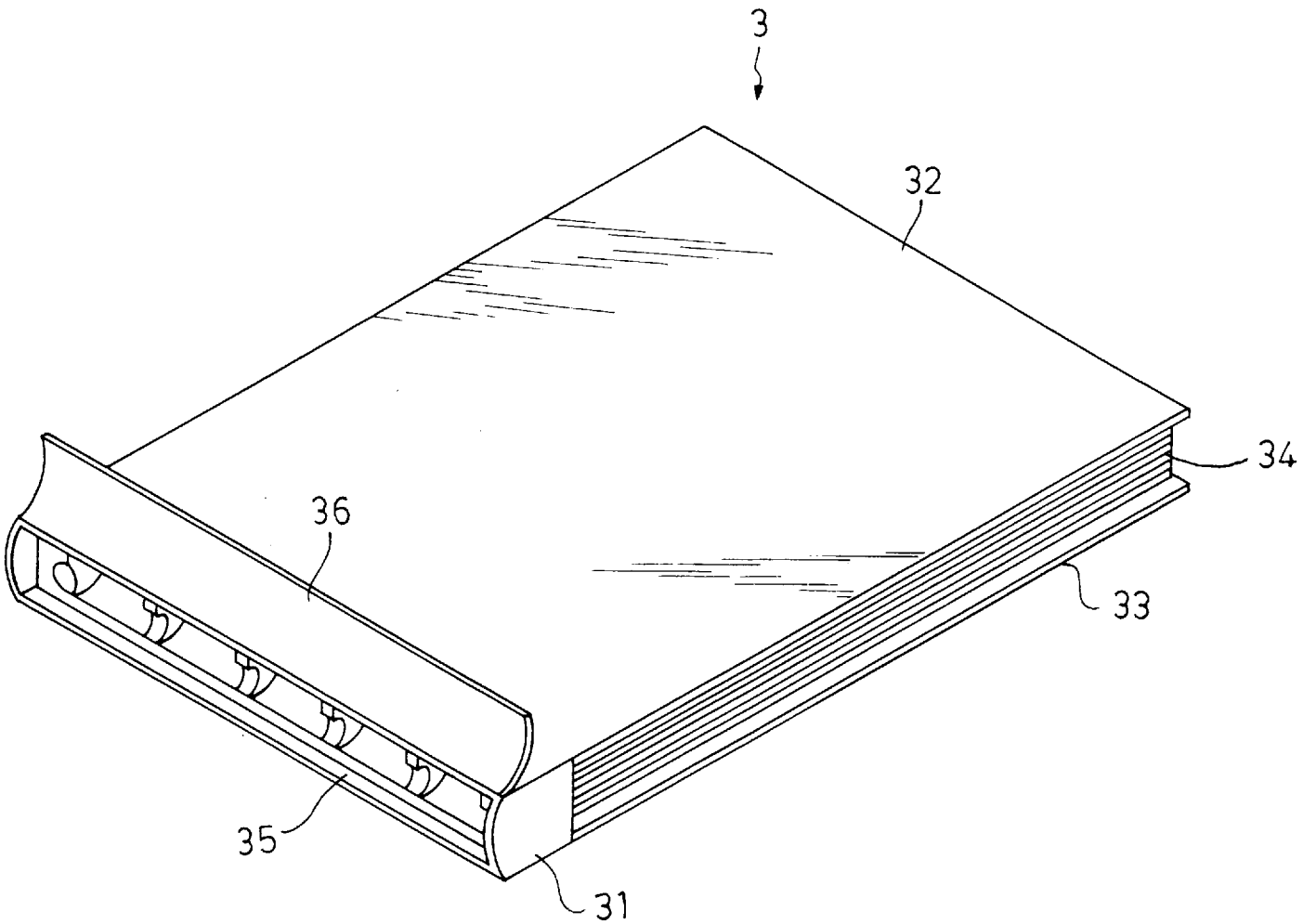
FIG. 4. is a perspective view of a second preferred embodiment of a photo album of this invention.

Referring to FIG. 4, the second preferred embodiment of a photo album 3 according to this invention is shown to comprise a binder shaft 31, a cover 36, top and bottom cover sheets 32, 33, and a plurality of picture holding sheets 34 which are hinged to the binder shaft 31. The photo album 3 differs from the first embodiment in that the cover 36 has one side pivoted to one of edges which confine an opening 35 so as to cover the opening 35. The other side of the cover 36 can be releasably held against the opposite one of the edges via engaging faces, a fastening strip, a zipper, buttons, etc.

Figure 5:
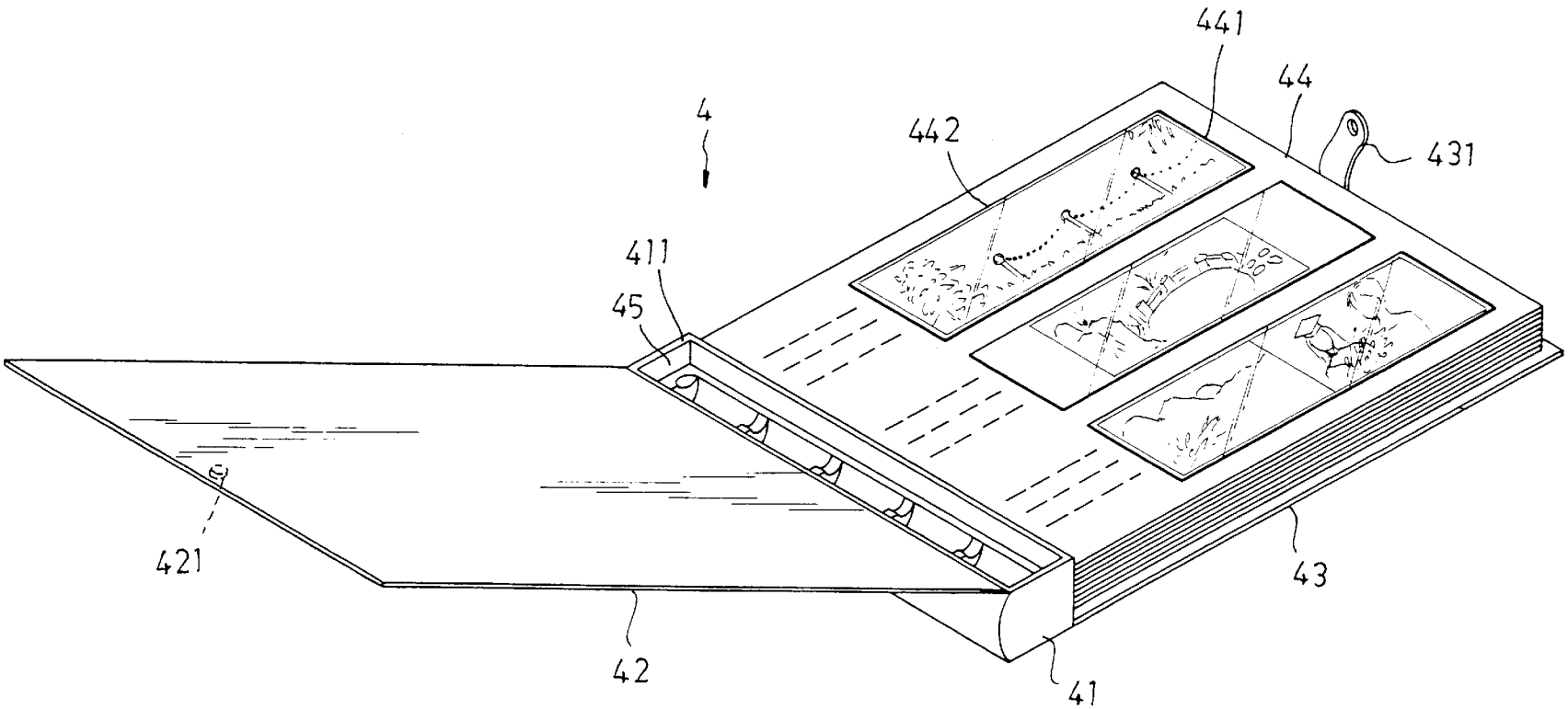
FIG. 5. is a perspective view of a third preferred embodiment of a photo album of this invention.

FIG. 5 shows the third preferred embodiment of the present invention. As compared to the first embodiment, the photo album 4 includes a binder shaft 41 which has a top side 411 adjacent to a top cover sheet 42. The top side 411 is formed with an opening 45. The top cover sheet 42 is hinged to the binder shaft 41 and extends over the opening 45 to act as a cover. The top and bottom cover sheets 42, 43 are provided respectively with a button 421 and a slotted fastening strip 431 to prevent the opening 45 from being uncovered undesirably. In addition, each of the picture pockets 441 on the picture holding sheets 44 has a top opening 442 so that two pictures of 3×5 inches can be received together.

Figure 6:
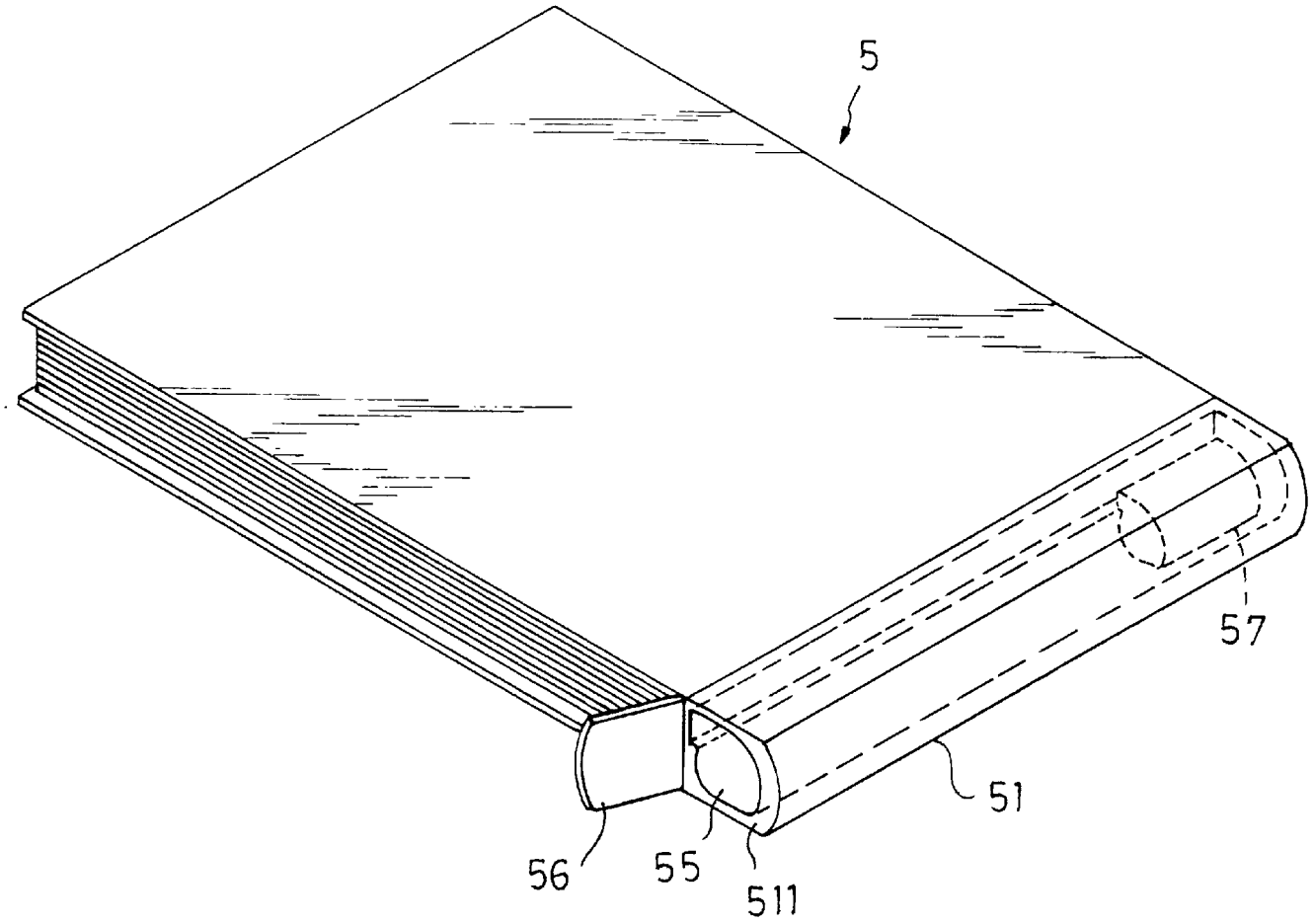
FIG. 6. is a perspective view of a fourth preferred embodiment of a photo album of this invention.

FIG. 6 shows a fourth preferred embodiment of the photo album 5 of the present invention. A binder shaft 51 of the photo album 5 differs from the first embodiment in that an opening 55 is formed in a transverse side 511, and that a cover 56 is pivoted to the inner side of the binder shaft 51. In addition, the binder shaft 51 is not formed with separate compartments therein, and the interior of the binder shaft 51 is sized to substantially conform to the cross-section of an APS film cartridge 57.

The advantages of the photo album of the present invention are as follows:

1. The picture pockets of the picture holding sheets can store three different common specifications of APS picture types, all of which have a width of 3 inches. Thus, the picture holding sheets are suitable for storing different sizes of the pictures developed from an APS film cartridge. Moreover, the picture pockets may include enlarged pockets of different sizes, such as 4×6 inches, 4×7 inches, and 4×11.5 inches.

2. By virtue of the compartments in the binder shaft for receiving a plurality of APS film cartridges, the pictures and the negatives of the APS film cartridges can be received in the same photo album, thereby eliminating the risk of losing the APS film cartridges and facilitating further development of the film thereof.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A photo album for storing pictures and APS film cartridges, comprising:

a binder shaft which has a receiving space therein for receiving the APS film cartridges, and an opening communicated with said receiving space for passage of the APS film cartridges;

top and bottom cover sheets;

a plurality of picture holding sheets which are sandwiched between said top and bottom cover sheets;

said top and bottom cover sheets and said picture holding sheets having connecting edge portions which are hinged to said binder shaft; and a cover for closing said opening of said binder shaft.

2. The photo album as claimed in claim 1, wherein said picture holding sheets include a plurality of picture pockets which are 3 inches in width and 10 inches in length.

3. The photo album as claimed in claim 1, wherein said receiving space of said binder shaft has a plurality of compartments for receiving a plurality of the APS film cartridges therein.

4. The photo album as claimed in claim 3, wherein said receiving space receives a separate molded member which is formed with said compartments.

5. The photo album as claimed in claim 1, wherein said binder shaft has a longitudinal inner side which faces said picture holding sheets, and an outer side which is opposite to said inner side and which is formed longitudinally with said opening.

6. The photo album as claimed in claim 5, wherein said binder shaft has two rails adjacent to said opening for slidable and detachable mounting of said cover.

7. The photo album as claimed in claim 5, wherein said cover is pivoted to said outer side of said binder shaft to cover said opening.

8. The photo album as claimed in claim 1, wherein said binder shaft has a top side which is adjacent to said top cover sheet and which is formed with said opening, said top cover sheet extending over said opening to act as said cover.

9. The photo album as claimed in claim 1, wherein said binder shaft has a longitudinal inner side which faces said picture holding sheets, and two opposite transverse sides which are transverse to said inner side, one of said transverse sides being formed with said opening.

* * * * *